US009486080B2

(12) United States Patent
Lin

(10) Patent No.: US 9,486,080 B2
(45) Date of Patent: Nov. 8, 2016

(54) BODY-SHAPING SUPPORT STRUCTURE

(71) Applicant: Wei-Ting Lin, Taipei (TW)

(72) Inventor: Wei-Ting Lin, Taipei (TW)

( * ) Notice: Subject to any disclaimer, the term of this patent is extended or adjusted under 35 U.S.C. 154(b) by 0 days.

(21) Appl. No.: 14/631,864

(22) Filed: Feb. 26, 2015

(65) Prior Publication Data

US 2015/0250318 A1 Sep. 10, 2015

(30) Foreign Application Priority Data

Mar. 4, 2014 (TW) ..... 103203648 U

(51) Int. Cl.
*A47C 7/02* (2006.01)

(52) U.S. Cl.
CPC ..... *A47C 7/022* (2013.01)

(58) Field of Classification Search
CPC ..... A47C 7/022
USPC ..... 297/452.21, 218.11, 218.12; 5/653, 657
See application file for complete search history.

(56) References Cited

U.S. PATENT DOCUMENTS 2,237,475 A * 4/1941 Church ..... B60N 2/38 297/228.11 X
5,678,245 A * 10/1997 Rector ..... A63B 71/143 2/19 X
8,936,313 B2 * 1/2015 Skarvan ..... B62J 1/20 297/219.11 X
2006/0076811 A1 * 4/2006 Thompson ..... A01M 31/02 297/228.12 X

* cited by examiner

*Primary Examiner* — Anthony D Barfield
(74) *Attorney, Agent, or Firm* — Leong C. Lei

(57) ABSTRACT

A body-shaping support structure includes a main body and a flexible body. The main body includes a shaping section. The shaping section is in a concave configuration. The main body has at least a portion including an elastic material and forming at least one adjustment gap to form a branch section and an adjustment section. The branch section is elastically deformable for adjustment. The flexible body is set to extend through and interlace the branch section and the adjustment section. The branch section is deformable and movable to achieve adjustment of the size of the shaping section. The flexible body connects the branch section and the adjustment section to each other so as to maintain effective fixation of the shaping section without changing the shape. The shaping section can receive a predetermined human body portion to be positioned thereon to enhance an effect of supporting and shaping the human body.

7 Claims, 6 Drawing Sheets

BODY-SHAPING SUPPORT STRUCTURE

TECHNICAL FIELD OF THE INVENTION

The present invention relates generally to a body-shaping support structure, and more particularly to one that is applicable to a mat that receives a human body to be positioned thereon and supported thereby and that forms a concave shaping section in which a predetermined human body portion is positionable to thereby enhance supporting and shaping of the human body.

DESCRIPTION OF THE PRIOR ART

Most of the modern people often lose their opportunity to move their bodies, particularly when they are working in the office, using computers, playing video games, watching TVs, and other occasions. They often forget to stand up and move their bodies and often take a fixed posture for a long period of time, such as sitting, lying, and leaning. People are fully aware that it is necessary to constantly stand up and move their bodies, after long sitting, lying, or leaning, for the purposes of enhancing the circulation of blood and consumption of calories so as to improve body health. However, due to being devoted to their works and games or simple because of personal habits, most people do not constantly stand up and move their bodies. This eventually leads to an increase of body weight and loosening their hips. Further, sitting, lying, or leaning long often results in poor and incorrect posture and causes civilization diseases, such as backache.

There are pad or mat related products or techniques that are currently available are proposed to receive a specific portion of a human body to be positioned thereon to achieve effects of support and shaping. Those mats are designed on the basic idea of ergonomics and they are only provided for supporting a specific portion of a human body, such as hips. With the body weight applied thereto, these products lose their function of supporting and undergo deformation. Thus, those mat products or techniques generally provide no sufficient power of support and the effect of body-shaping is generally poor consequently.

The present invention aims to provide a solution that overcomes the above problems.

SUMMARY OF THE INVENTION

An object of the present invention is to provide a body-shaping support structure that allows a predetermined human body portion to be positioned thereon to enhance the effect of support and shape the human body.

To achieve the above object, the present invention comprises a main body and a flexible body. The main body comprises a shaping section. The shaping section is in a concave configuration. The main body has at least a portion comprising an elastic material and forming at least one adjustment gap to form a branch section and an adjustment section. The branch section is elastically deformable for adjustment. The flexible body is set to extend through and interlace the branch section and the adjustment section to connect and fix the branch section and the adjustment section. The branch section is deformable and movable to achieve adjustment of the size of the shaping section. The flexible body connects the branch section and the adjustment section to each other so as to maintain effective fixation of the shaping section without changing the shape. The shaping section can receive a predetermined human body portion to be positioned thereon to enhance an effect of supporting and shaping the human body so as to overcome the drawback of the conventional mat having a poor supporting and shaping effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
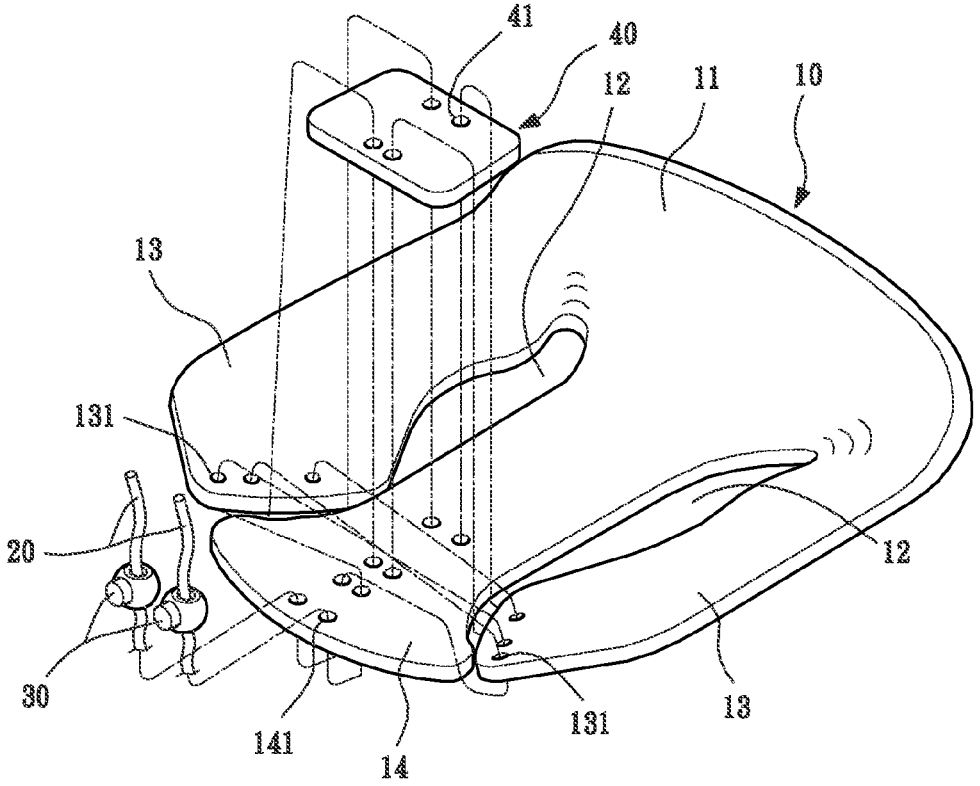
FIG. 1 is an exploded view of the present invention.
Figure 6:
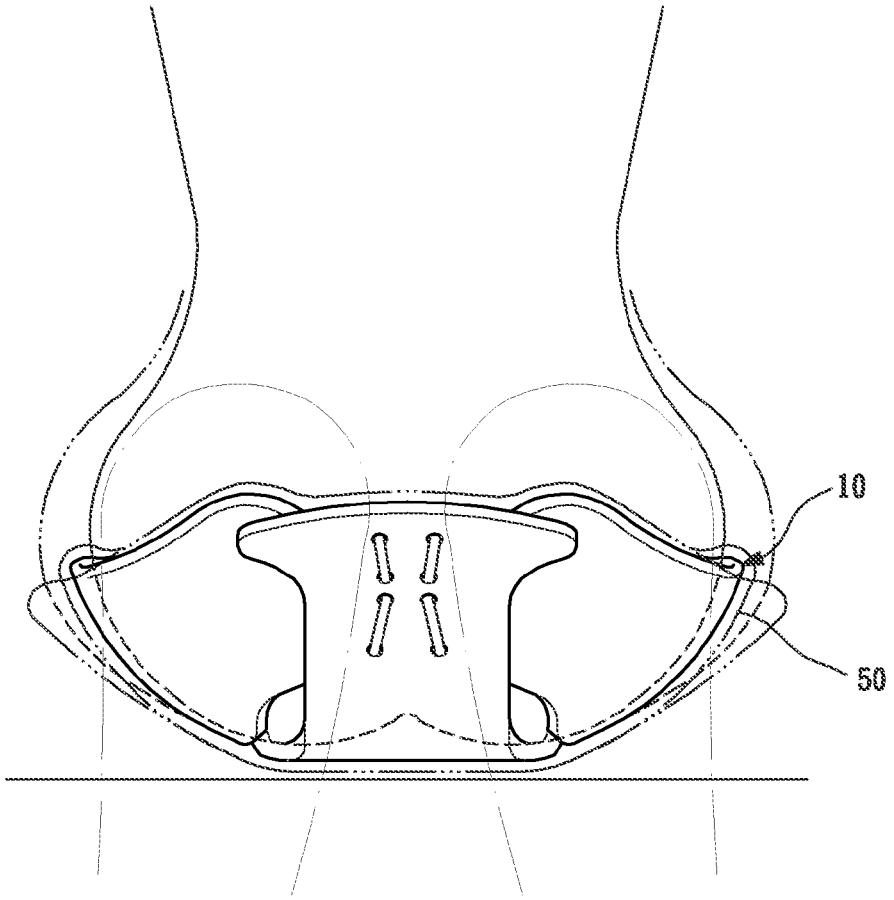
FIG. 6 is a schematic view showing an example of use of the present invention.

Referring to FIGS. 1 and 6, the present invention comprises a main body 10 and a flexible body 20, which collectively form a mat that receives a predetermined portion of a human body to be positioned thereon, such as hips, to improve an effect of supporting and shaping the human body.

Figure 2:
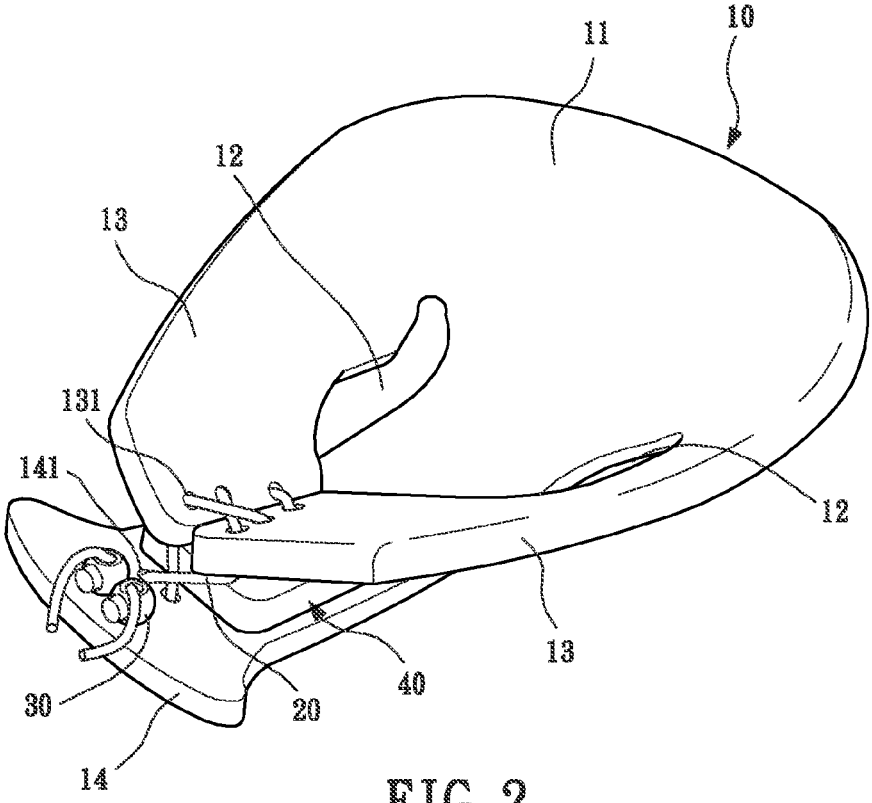
FIG. 2 is a perspective view of the present invention.
Figure 3:
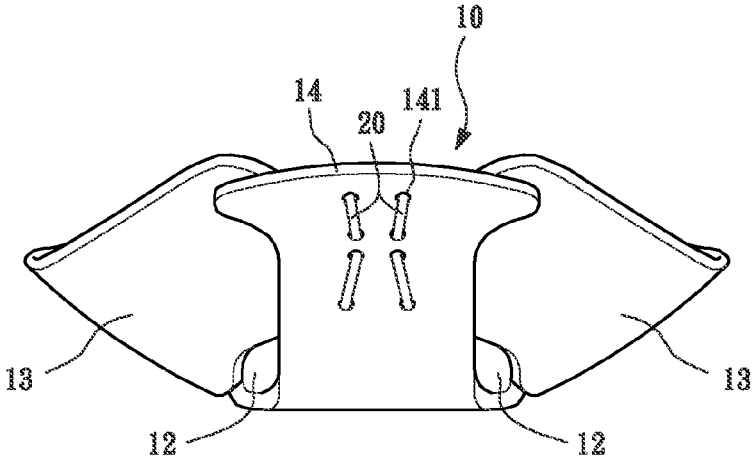
FIG. 3 is a front view of the present invention.

Referring to FIGS. 1, 2, and 3, the main body 10 of the present invention comprises a shaping section 11. The shaping section 11 is generally in a form of a concave configuration. In the instant embodiment, the main body 10 can be integrally molded to form the shaping section 11. The main body 10 has at least a portion comprising an elastic material (such as plastics, EVA, and the likes) and forming a plurality of adjustment gaps 12 so as to define a plurality of branch sections 13 and an adjustment section 14, wherein the branch sections 13 allows for elastic deformation to achieve adjustment of the size of the shaping section 11, such as flexing outward/inward and/or upward/downward or any other arbitrary deflection. The branch sections 13 and the adjustment section 14 are respectively provided, at predetermined locations, with a plurality of through holes 131, 141.

The flexible body 20 is set to extend through the branch sections 13 and the adjustment section 14 so as to connect and fix the branch sections 13 and the adjustment section 14 thereby enabling fixing of the shaping section 11 after size adjustment. In the instant embodiment, a string is taken as an example of the flexible body 20 for illustration. The flexible body 20 is set to extend through and interlace, in an alternate and intersecting manner, the branch sections 13 and the adjustment section 14 in order to enhance the force of connection and fixation. The extension of the flexible body 20 through the branch sections 13 and the adjustment section 14 is generally set through the through holes 131, 141.

The present invention further comprises two retainers 30. The retainers 30 are respectively mounted to two end sections of the flexible body 20 in such a way as to be movable along the flexible body 20 and to selectively fix and retain the flexible body 20. When the retainers 30 are positioned against the main body 10, the flexible body 20 so interlacing is prevented from loosening so as to securely connect and fix the branch sections 13 and the adjustment section 14. In the instant embodiment, the retainers 30 are string buckles and pressing down the retainers 30 releases the flexible body 20 and releasing the retainers 30 secures the flexible body 20.

The present invention comprises an adjustment seat 40. The adjustment seat 40 comprises a plurality of through apertures 41, wherein the flexible body 20, when set to extend through and interlace the branch sections 13 and the adjustment section 14, is allowed to extend through the through apertures 41 of the adjustment seat 40 to enhance the force of connection and fixation.

Figure 4:
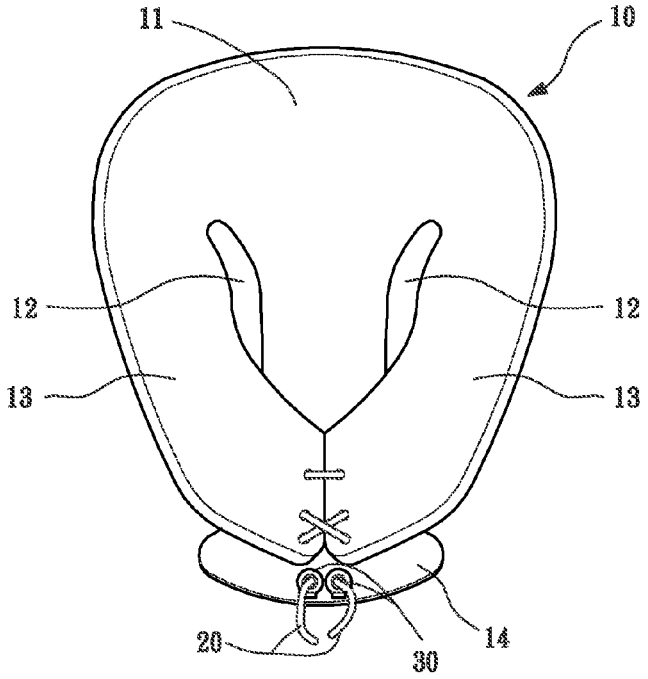
FIG. 4 is a top plan view of the present invention.
Figure 5:
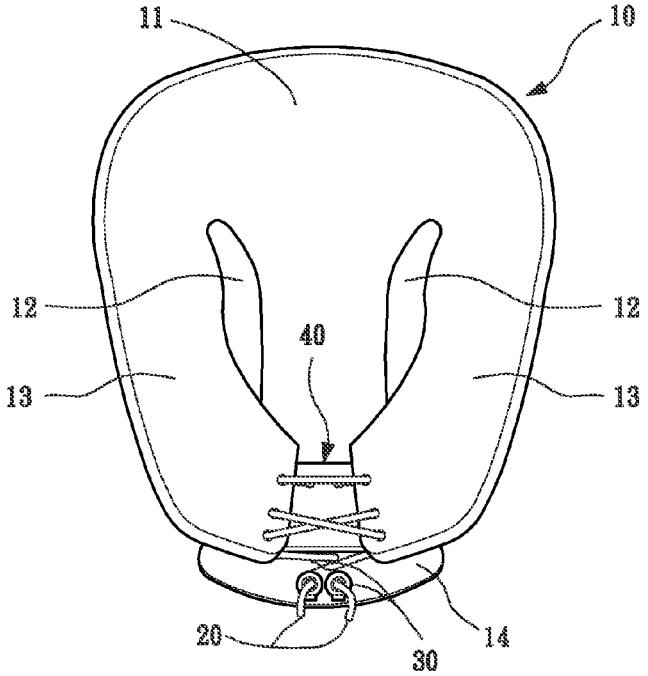
FIG. 5 is a top view of the present invention showing a shaping section of FIG. 4 is expanded.

Referring to FIGS. 4 and 5, in the use of the present invention, the flexible body 20 is used to connect and fix the branch sections 13 and the adjustment section 14 so as to set and fix the size of the shaping section 11. To adjust the size of the shaping section 11, the retainers 30 are pressed down to release the flexible body 20 for adjustment. Under this condition, the branch sections 13 are elastically deformable for size adjustment, such as being flexed outward, so that the adjustment of the size of the shaping section 11 can be carried out and achieved. Afterwards, the retainers 30 are released to again secure the interlaced flexible body 20 against loosening thereby fixing the size of the shaping section 11 without undesired shape changing.

Further, the size adjustment structure of the shaping section 11 provided by the present invention allows the present invention to be fit to different users.

Referring to FIG. 6, due to the effective fixation achieved with the flexible body 20, the shaping section 11 of the present invention does not change shape so that the concave configuration of the shaping section 11 can receive a predetermined human body portion, such as hips, to be positioned thereon and provide an enhanced effect of supporting and shaping the human body to thereby overcome the drawback of the conventional mat having a poor supporting and shaping effect.

In one embodiment, the main body 10 of the present invention has an outside surface that is enclosed by an enclosure 50 to improve aesthetics thereof.

Figure 7:
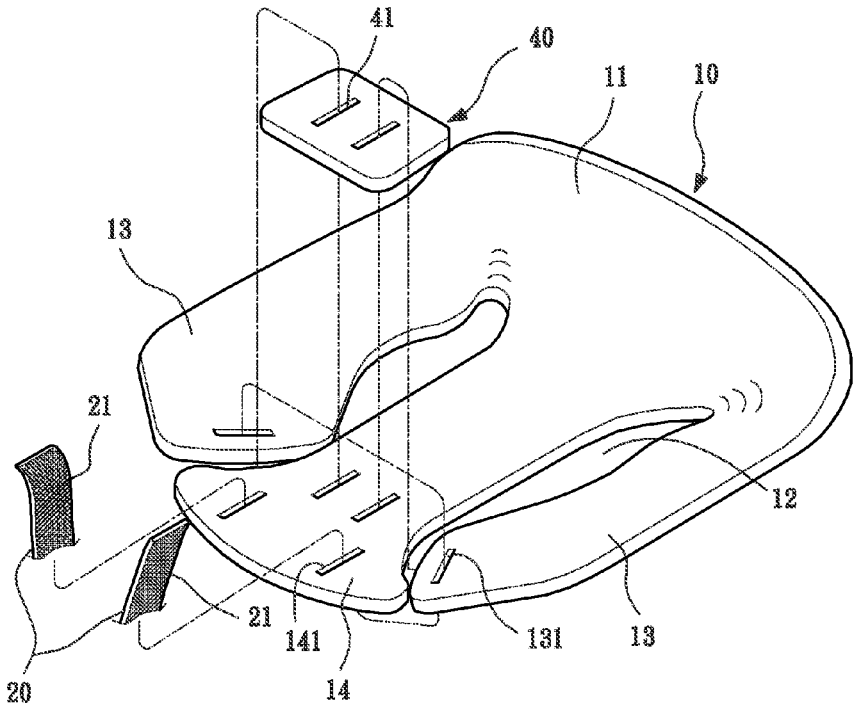
FIG. 7 is an exploded view of another structure of the present invention.
Figure 8:
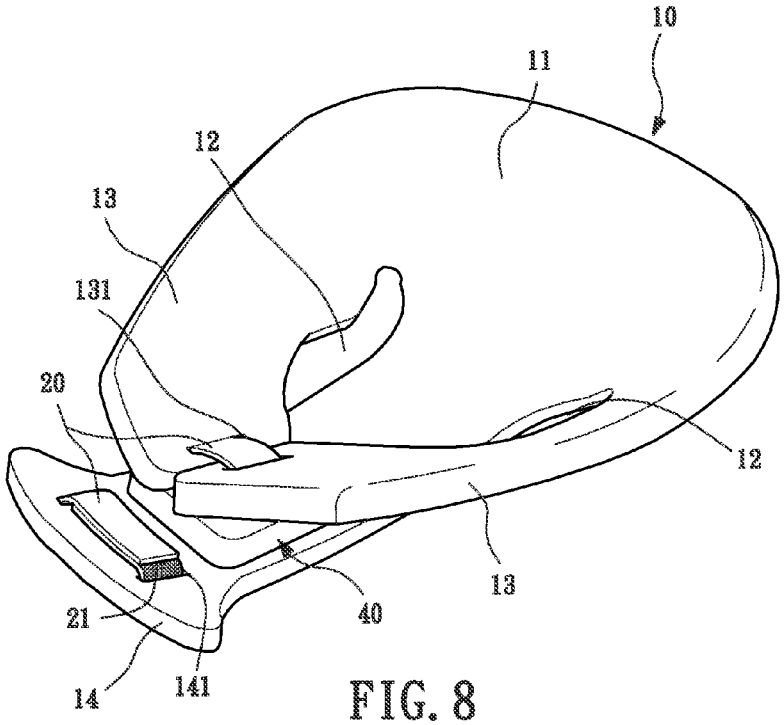
FIG. 8 is a perspective view of said another structure of the present invention.

Referring to FIGS. 7 and 8, in one embodiment, the flexible body 20 comprises a flat braided belt and the through apertures 41 of the adjustment seat 40 are elongated to correspond to and receive for easy extension of the flexible body 20 in order to improve the comfortableness of human body in engagement with each other. The flexible body 20 has two end sections that are provided with fastenable sections 21, such as hook-and-loop fasteners, with which the two end sections of the flexible body 20 can be fastened in a removable manner to retain and fix the interlaced flexible body 20 against getting loosened.

Figure 9:
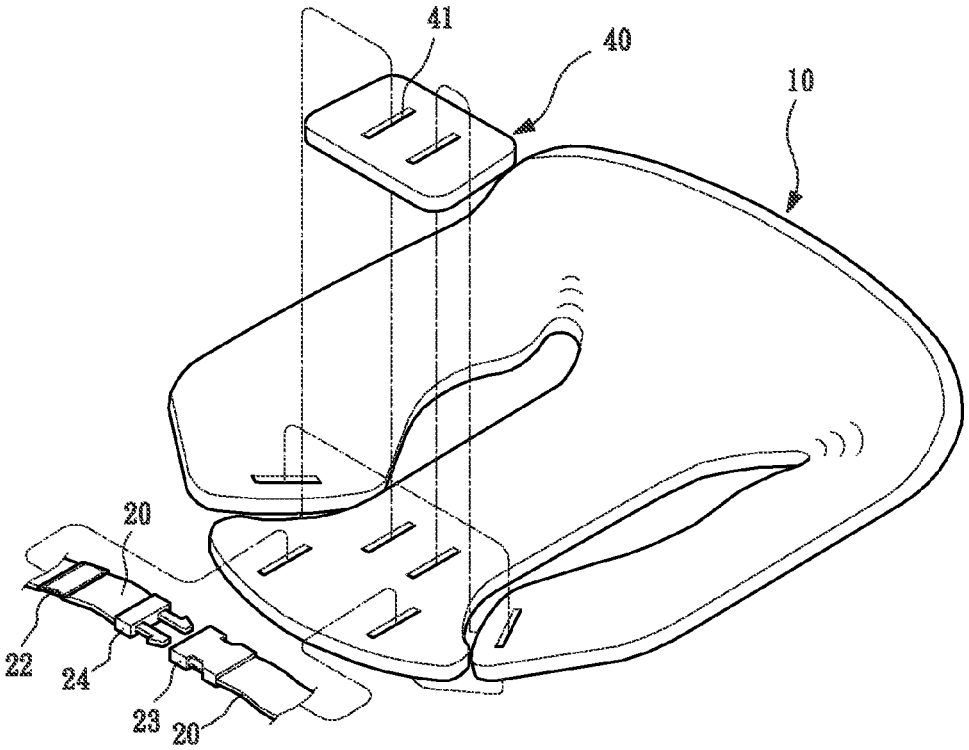
FIG. 9 is an exploded view of a further structure of the present invention.

Referring to FIG. 9, in one embodiment, the flexible body 20 comprises a flat braided belt and the through apertures 41 of the adjustment seat 40 are elongated to correspond to and receive for easy extension of the flexible body 20 in order to improve the comfortableness of human body in engagement with each other. The flexible body 20 is set through an adjustment ring 22 for adjusting the length of the flexible body 20. The flexible body 20 has two ends respectively provided with engageable buckle parts 23, 24, such as elastic pawls and retention slots, with which the two end sections of the flexible body 20 can get engagement with and thus coupled to each other in a releasable manner to retain and fix the interlaced flexible body 20 against getting loosened.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A body-shaping support structure, comprising:

a main body, which comprises a shaping section, the shaping section being in a concave configuration, the main body having at least a portion comprising an elastic material and forming at least one adjustment gap to form a branch section and an adjustment section, wherein the branch section is elastically deformable for adjustment; and a flexible body, which is set to extend through and interlace the branch section and the adjustment section to connect and fix the branch section and the adjustment section;

wherein the branch section movable with respect to the adjustment section between a first relative position and a second relative position to respective set the adjustment gap between a first configuration where the branch section is spaced from the adjustment section and a second configuration where the branch section partly overlaps the adjustment section; and wherein the flexible body comprises a section having a variable length that is variable between and selectively set at a first length, which retains the gap at the first configuration and a second length, which is different from the first length and retains the gap at the second configuration for selectively switching the branch section between the first relative position and the second relative position.

2. The body-shaping support structure according to claim 1, wherein the branch section and the adjustment section are each provided, at predetermined locations, with a plurality of through holes to receive the extension of the flexible body therethrough.

3. The body-shaping support structure according to claim 1 further comprising at least one retainer, the retainer being mounted to the flexible body to be movable along the flexible body and selectively fix the flexible body.

4. The body-shaping support structure according to claim 3, wherein the retainer comprises a string buckle.

5. The body-shaping support structure according to claim 1 further comprising an adjustment seat, the adjustment seat comprising a plurality of through apertures, wherein the flexible body that is set to extend through and interlace the branch section and the adjustment section is also set through the through apertures of the adjustment seat.

6. The body-shaping support structure according to claim 1, wherein the flexible body has two end sections that form fastenable sections so that the two ends of the flexible body are fastenable in a releasable manner.

7. The body-shaping support structure according to claim 1, wherein the flexible body extends through an adjustment ring for adjustment of a length of the flexible body, the flexible body having two end sections that are respectively provided with engageable buckle parts so that the two ends of the flexible body are engageable with and thus coupled to each other in a releasable manner.

* * * * *